United States Patent [19]

Wolski

[11] 4,064,722

[45] Dec. 27, 1977

[54] KEY CASE AND WATCH COMBINATION

[76] Inventor: Pearl M. Wolski, 13 Hartford St., South Hadley, Mass. 01075

[21] Appl. No.: 719,327

[22] Filed: Aug. 31, 1976

[51] Int. Cl.[2] ..... A44B 15/00; A45C 11/32; A47G 29/10

[52] U.S. Cl. ..... 70/456 B; 224/4 A

[58] Field of Search ..... 70/456 R, 456 B; 150/40; 224/4 A, 4 B, 4 C; 248/114

[56] References Cited

U.S. PATENT DOCUMENTS

| | | | |
|---|---|---|---|
| 1,260,539 | 3/1918 | Hertz | 224/4 B |
| 1,434,775 | 11/1922 | Fenno | 224/4 A |
| 3,115,288 | 12/1963 | Aszkenas | 224/4 C |
| 3,547,323 | 12/1970 | Sledge, Jr. et al. | 70/456 R |
| 3,552,117 | 1/1971 | Parris | 224/4 A |

*Primary Examiner*—Paul R. Gilliam

*Attorney, Agent, or Firm*—Clarence A. O'Brien; Harvey B. Jacobson

[57] ABSTRACT

A key case and watch combination in which the watch is attached to the outside of the key case by snap fasteners. In this manner, the standard wristwatch provided with snap fasteners for attachment to a watchband can be readily attached to the key case, as desired, for permitting the watch to be observed by the driver of a motor vehicle.

4 Claims, 3 Drawing Figures

KEY CASE AND WATCH COMBINATION

BACKGROUND OF THE INVENTION

1. Field of the Invention

This invention relates generally to a key case and watch combination, and particularly to an arrangement which permits a conventional wristwatch to be selectively attached to a key case.

2. Description of the Prior Art

The clocks commonly provided as optional equipment by automobile manufacturers are notoriously unreliable, and as a result are generally held in low esteem by the motoring public. If a vehicle is even provided with a clock, the chances are quite good that this clock will not be in operating condition if the vehicle has many miles on it.

As a result of the unreliability and unpopularity of the automobile clocks generally available, it has been proposed to combine key holders and watches in such a manner as to permit the watch to be read by an operator of a motor vehicle, the ignition key to which is attached to the key holder or case. Examples of prior devices proposed for this purpose, as well as similar proposals can be found in U.S. Pat. Nos:

2,268,032 — Dec. 30, 1941
2,424,290 — July 22, 1947
2,470,466 — May 17, 1949
2,596,374 — May 13, 1952
2,745,244 — May 15, 1956
3,908,418 — Sep. 30, 1975.

SUMMARY OF THE INVENTION

It is an object of the present invention to provide a key case and watch combination which permits a conventional wristwatch to be selectively mounted on a key case.

It is another object of the present invention to provide a key case and watch combination in which the watch is mounted on the case in such a manner as to permit the watch to be removed from the case as desired for use separate from the key case.

These and other objects are achieved according to the present invention by providing a key case and watch combination having an attachment arrangement associated with both the key case and watch for detachably connecting the watch on the key case. More specifically, this attachment arrangement preferably includes a pair of spaced first snap fastener parts affixed to the key case, and a pair of spaced second snap fastener parts provided on the watch for selectively cooperating with the first snap fastener parts and connecting the watch to the key case.

Advantageously, the watch is a conventional wristwatch provided with a pair of band attaching pins, with the second snap fastener parts being mounted on the pins. More specifically, the second snap fastener parts include in addition to a snap element per se a preferably flexible piece of material possibly folded over on itself or otherwise provided with a through hole which receives the pin of the watch in order to mount the snap element on the watch.

The key case can be constructed from a rigid or flexible material as desired, but if it is constructed from a flexible material, a semi-rigid reinforcing strip is preferably disposed on the inner surface of the case so as to be held against the case by snap elements of the first snap fastener parts and rigidify the case with respect to the associated watch.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
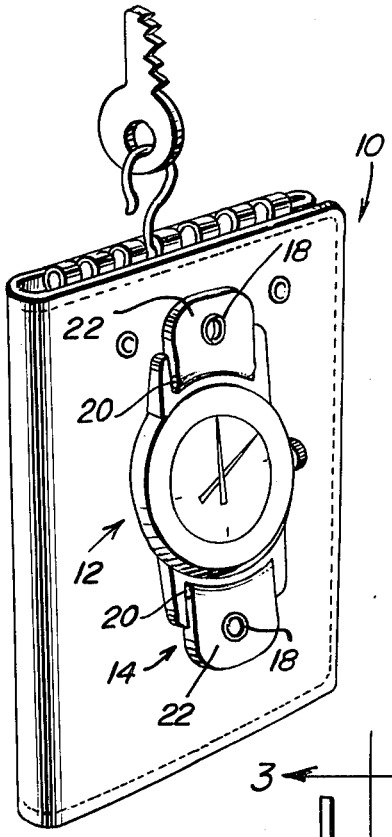
FIG. 1 is a perspective view showing a key case and watch combination according to the present invention.
Figure 3:
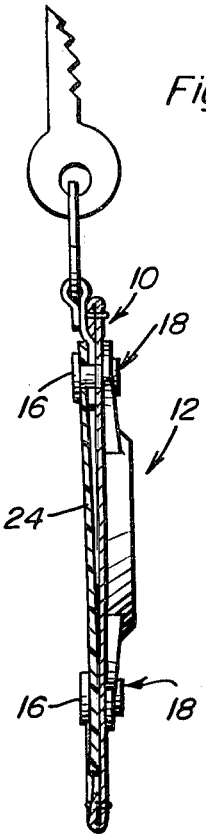
FIG. 3 is a sectional view taken generally along the line 3—3 of FIG. 2.
Figure 2:
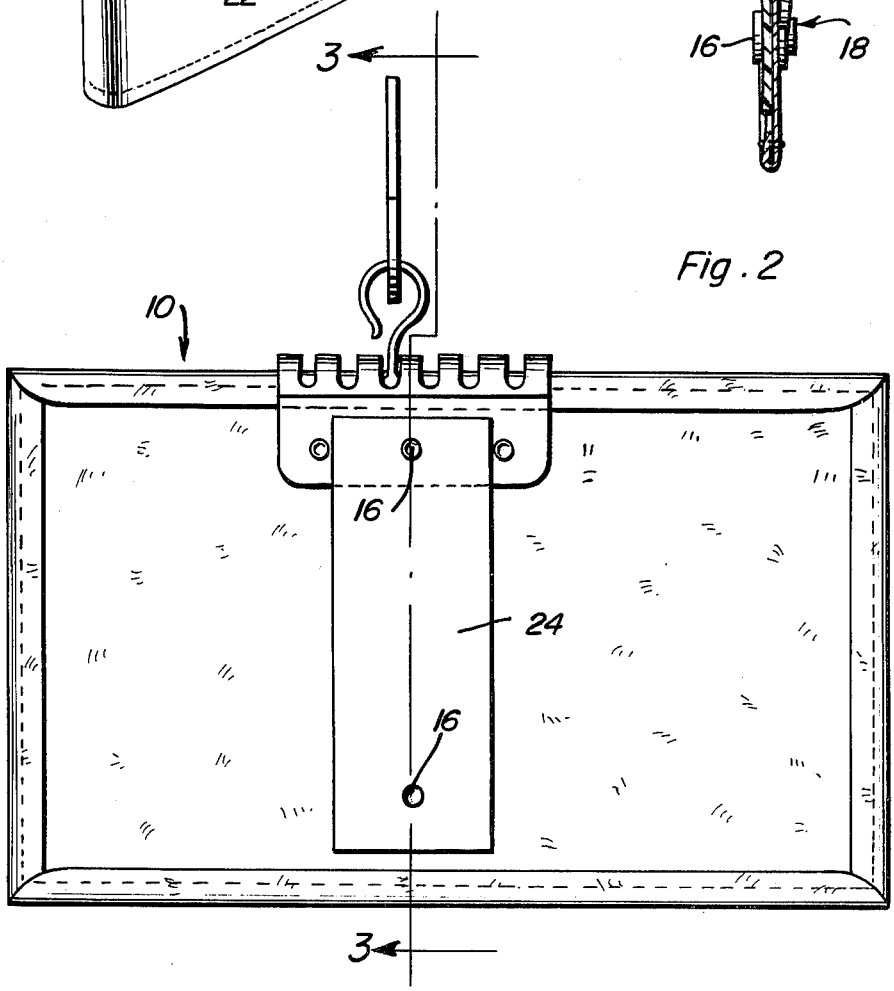
FIG. 2 is a rear elevational view showing the key case of FIG. 1 in an open mode.

Referring now more particularly to the figures of the drawing, a key case 10 of conventional construction has mounted on an outside surface thereof a wristwatch 12. Associated with both case 10 and watch 12 is an attachment arrangement 14 for detachably connecting the watch 12 to case 10.

Attachment arrangement 14 includes a pair of spaced first snap fastener parts 16 affixed to case 10, and a pair of spaced second snap fastener parts 18 provided on watch 12 so as to selectively, matingly cooperate with part 16 and attach watch 12 to case 10. The watch 12 is provided in the conventional manner with a pair of band attaching pins 20 on which are disposed the second snap fastener parts 18 by means of the pieces 22. The latter can either be pieces of flexible material, such as leather, vinyl, and the like, folded on itself or otherwise provided with a through hole which receives a respective one of the pins 20 in order to attach piece 22 to watch 12. The snap fastener part 18 can then be mounted on the respective piece 22 in a conventional manner.

When key case 10 is constructed from a flexible material as is illustrated in the drawing, it is provided with a semi-rigid reinforcing strip 24 disposed so as to be secured to an inner surface of case 10 as by the snap fastener part 16. Thus, the strip 24 partially supports the snap fastener part 16 while stiffening the back of case 10 in order to facilitate attachment of watch 12 to the case.

As can be appreciated from the above description and from the drawing, a key case, including rigid cases as well as the illustrated flexible case, can be provided with a pair of snap fastener parts by a manufacturer, and any standard size wristwatch provided with watchband engaging snap fastener parts can be readily attached to the case. In this manner, a reliable timepiece can be provided as a substitute for the standard dashboard clock in an automobile.

Further, a key case according to the invention can be convenient for use by persons with skin conditions and unable to wear a wristwatch, as well as by golfers and others engaged in physical activities who do not want to subject a wristwatch to constant pounding as when a golf ball is hit.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a key case, a watch, and attachment means associated with both the key case and the watch for detachably connecting the watch to the key case, the attachment means including a pair of spaced first snap fastener parts affixed to the key case, and a pair of spaced second snap fastener parts provided on the watch for selectively cooperating with the first snap fastener parts, the key case being constructed from a flexible material and including a semi-rigid reinforcing strip arranged covering a back of the case for stiffening same, the first snap fastener parts being partially supported by the strip.

2. A combination as defined in claim 1, wherein the watch is a wristwatch having a pair of band attaching pins, with the attachment means including conventional snap fastener parts mounted on the pins.

3. A combination as defined in claim 2, wherein the back of the case has an outside surface and an inner surface, with the semi-rigid reinforcing strip being secured to the inner surface as by the first snap fastener parts, and the watch being detachably connected adjacent the outside surface of the back of the case.

4. A combination as defined in claim 1, wherein the back of the case has an outside surface and an inner surface, with the semi-rigid reinforcing strip being secured to the inner surface as by the first snap fastener parts, and the watch being detachably connected adjacent the outside surface of the back of the case.

* * * * *